United States Patent [19]

Takei

[11] 4,327,674

[45] May 4, 1982

[54] APPARATUS FOR COOLING A VEHICLE ENGINE ROOM

[75] Inventor: Hirofumi Takei, Yokosuka, Japan

[73] Assignee: Nissan Motor Co., Ltd., Yokohama, Japan

[21] Appl. No.: 125,858

[22] Filed: Feb. 29, 1980

[30] Foreign Application Priority Data

Mar. 6, 1979 [JP] Japan ..... 54-28195[U]

[51] Int. Cl.[3] ..... F01P 7/08

[52] U.S. Cl. ..... 123/41.12; 123/41.49; 123/41.66; 165/51

[58] Field of Search ..... 123/41.02, 41.11, 41.12, 123/41.49, 41.65, 41.66, 41.70; 165/41, 51; 98/2.06, 121 R; 180/69 R

[56] References Cited

U.S. PATENT DOCUMENTS

| | | | |
|---|---|---|---|
| 3,394,682 | 7/1968 | Bensinger | 123/41.12 |
| 3,964,444 | 6/1976 | Hemmann et al. | 123/41.49 |
| 4,168,456 | 9/1979 | Isobe | 123/41.12 |
| 4,194,484 | 3/1980 | Kirchweger et al. | 123/41.7 |

FOREIGN PATENT DOCUMENTS

| | | | |
|---|---|---|---|
| 2504140 | 8/1975 | Fed. Rep. of Germany | 123/41.65 |
| 1003287 | 9/1965 | United Kingdom | 165/51 |

*Primary Examiner*—Craig R. Feinberg
*Assistant Examiner*—W. R. Wolfe
*Attorney, Agent, or Firm*—Schwartz, Jeffery, Schwaab, Mack, Blumenthal & Koch

[57] ABSTRACT

When a vehicle stops after heavy load operation, residual heat of exhaust system heats engine room or so-called hot soak condition prevails the engine room resulting in the vapor lock or percolation of fuel. Natural draught is not sufficient to avoid overheating of the fuel system. An engine cooling motor-driven fan is driven when a temperature switch detects high temperature of the exhaust manifold after the main ignition key is turned off, so as to improve restarting and reacceleration performances of the vehicle.

4 Claims, 5 Drawing Figures

APPARATUS FOR COOLING A VEHICLE ENGINE ROOM

BACKGROUND OF THE INVENTION

The present invention relates to an apparatus for cooling a vehicle engine room which contains an internal combustion engine, and a motor-driven fan to cool the engine.

In such a vehicle, when the engine is stopped after a heavy load driving, residual heat of exhaust system of the engine heats atmosphere in the engine room. Under such a condition, or in the so-called hot soak condition, fuel system in the engine room is heated above a temperature which causes vapor lock or percoration of fuel in the fuel system located near the suction system of the engine.

Conventionally, in order to mitigate the above mentioned problem, an engine hood of the engine room is formed with a louver to promote natural draught through the engine room and to vent hot air heated by residual heat of the exhaust system.

However, such a louver may not be formed to have a sufficiently large opening area owing to the limitations relating to appearance of the vehicle. Thus, natural draught capacity of the louver may not be enough to vent out of the engine room large quantity of heat resulting from the residual heat of the exhaust system just after stopping the engine. Consequently, problem of the vapor lock or percolation of fuel cannot be completely eliminated.

SUMMARY OF THE INVENTION

Accordingly, an object of the present invention is to eliminate the above mentioned problem, and to provide an apparatus for cooling a vehicle engine room, which is automatically actuated if necessary even when the engine is stopped.

According to the present invention, an apparatus for cooling a vehicle engine room comprises a motor-driven fan to cool the engine, circuit means adapted to drive the fan in the stopped condition of the engine, and a temperature switch means operably connected with said circuit means and actuated to drive the fan by detecting hot soak condition of the engine room, whereby said fan is driven for a predetermined period when the engine is stopped after a heavy load operation.

The apparatus according to the present invention provides forced draught through the engine room just after the engine is stopped, so that exhaust system of the engine is rapidly cooled and fuel system in the engine room is not overheated. Since the fan is driven until the exhaust system is cooled sufficiently, residual heat of the exhaust system does not heat the fuel system even after the fan is stopped.

An overall forced draught efficiency in the hot soak condition is determined by various factors. In general, the draught efficiency can be improved by driving the fan in the reverse direction, rather than in the normal direction.

For a better understanding of the invention and to show how the same may be carried into effect, reference will now be made, by way of example, to the accompanying drawing.

DETAILED DESCRIPTION OF PREFERRED EMBODIMENTS

Figure 1:
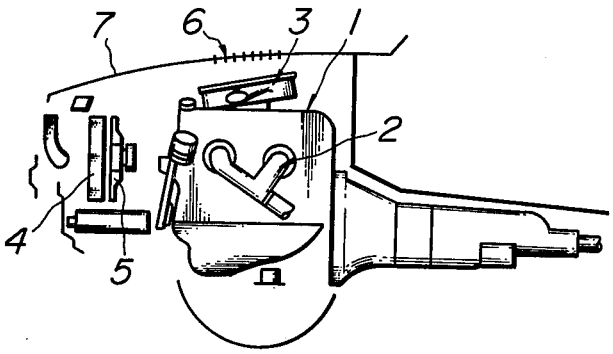
FIG. 1 is an illustration of a conventional vehicle engine room to which the present invention may be applied.

FIG. 1 shows a conventional arrangement of a vehicle engine room, to which the present invention may be applied. The engine room contains therein an internal combustion engine 1 with an exhaust system 2 and a suction system 3 including an air cleaning element, one or more carburettors and corresponding number of suction manifolds (not shown), and a radiator 4 associated with a radiator cooling fan 5 driven by a motor. In the arrangement shown in FIG. 1, a louver 6 is formed through an engine hood 7.

According to the present invention, when the engine 1 is stopped and temperature of the exhaust system 2 is more than a predetermined value, forced draught through the engine room is effected by driving the radiator cooling fan 5.

Figure 2:
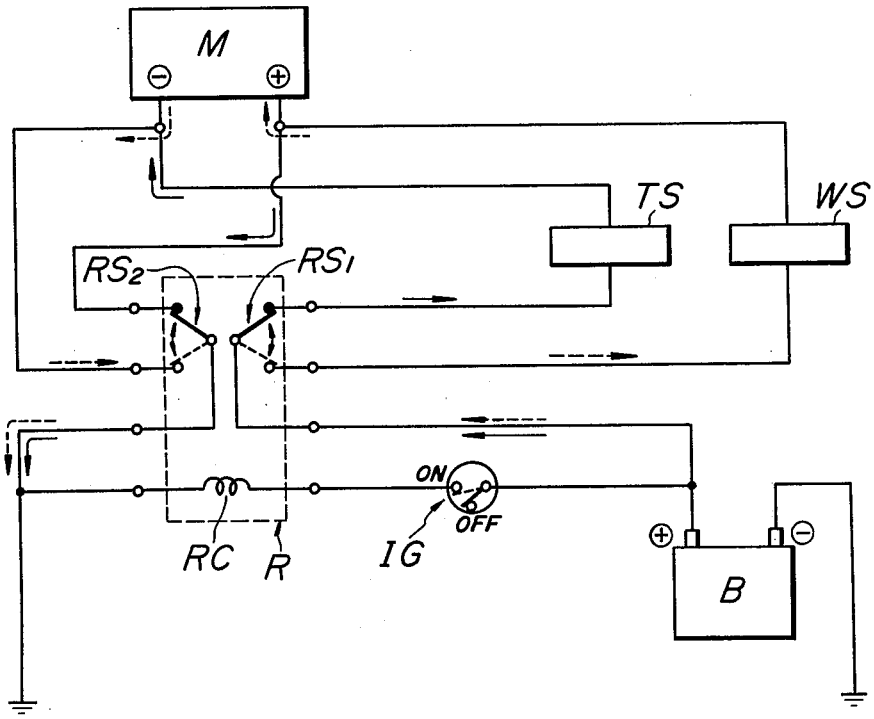
FIG. 2 is a diagram showing one example of a circuit for driving the fan motor, according to the present invention.

FIG. 2 shows one example of an electric circuit to perform the reverse drive of the motor m in the hot soak condition, according to the present invention. An electric source B, e.g. a battery is connected, through an ignition switch IG, with a relay R having a coil RC which is energized or deenergized according to ON or OFF condition of the ignition switch IG.

When the ignition switch IG is turned ON, the coil RC of the relay R is energized to hold relay switch contacts $RS_1$ and $RS_2$ as shown by phantom lines in FIG. 2. A cooling water temperature switch WS becomes ON when the temperature of the engine cooling water exceeds a predetermined value, e.g. 85° C. Thus, a motor M of the fan 5 is energized, as shown by arrows of phantom line, through the switch WS and the relay switch contacts $RS_1$ and $RS_2$ of the relay R. In this case, the motor M is driven in the normal direction to cool the radiator 4.

When the engine 1 is stopped and the ignition switch IG is turned OFF, the relay coil RC of the relay R is deenergized so that the relay switch contacts $RS_1$ and $RS_2$ are switched as shown by solid lines in FIG. 2. A temperature switch TS is turned ON when the temperature of the exhaust system 2 exceeds a predetermined value, e.g. 400° C. to 600° C. Thus, current is supplied to the motor M, as shown by arrows of solid line in FIG. 2, through the relay switch contacts $RS_1$ and $RS_2$ and the temperature switch TS. In this case, the motor M is driven in the reverse direction.

Figure 3:
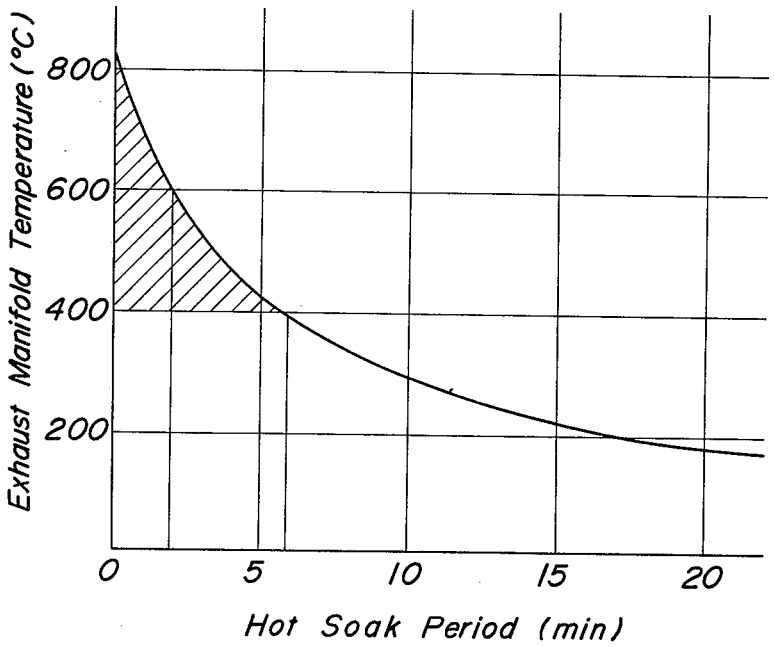
FIG. 3 is a diagram showing the exhaust manifold temperature after the engine is stopped.

FIG. 3 is a diagram showing the variation in the exhaust manifold temperature of the exhaust system 2 when the engine 1 is stopped after a high load driving, i.e. in the so-called hot soak condition. When the setting temperature of the temperature switch TS shown in FIG. 2 is selected to be 600° C. to 400° C., the motor driven fan 5 is energized for about 2 to 6 minutes in the reverse direction after the ignition switch IG is turned OFF. Consequently, forced draught through the engine room quickly vents large quantity of heat in the engine room into atmosphere.

Figure 4:
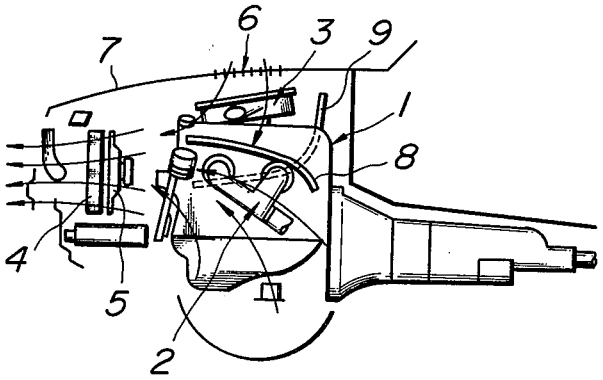
FIG. 4 is an illustration of an engine room showing another embodiment of the present invention.

FIG. 4 shows a preferred embodiment of the present invention, which may be combined with the electrical circuit shown in FIG. 2. An air guide plate 8 is arranged on one side of the engine 1, which covers an upper portion of the exhaust system 2 including the exhaust manifold. Another air guide plate 6 is arranged on opposite side of the engine, which covers a lower portion of the suction system 3. When the engine 1 is stopped and the radiator cooling fan 5 is driven in the reverse direction, heat dissipated from the exhaust system 3 is efficiently vented to atmosphere by fresh air flow guided by the exhaust side air guide plate 8, and the suction system 3 is cooled efficiently by the ambient air flow which is introduced through the louver 6 and guided by the suction side air guide plate 9.

In the embodiment shown in FIGS. 4, the engine 1 is shown as being a reciprocating engine having cross flow type combustion chambers. In a reciprocating engine having wedge type combustion chambers, a single air guide plate may be arranged between the exhaust system and the suction system, which efficiently vents hot air from the exhaust system and cools the suction system by atmosphere, so that the suction system is not overheated.

In the embodiment shown in FIG. 2, the temperature switch TS which is inserted in the circuit for driving the motor M of the fan 5 in the reverse direction operates by detecting the exhaust manifold temperature. The temperature switch TS may be operated by detecting temperature of an element located adjacent to the exhaust system 3, or temperature of atmosphere near the exhaust system.

Figure 5:
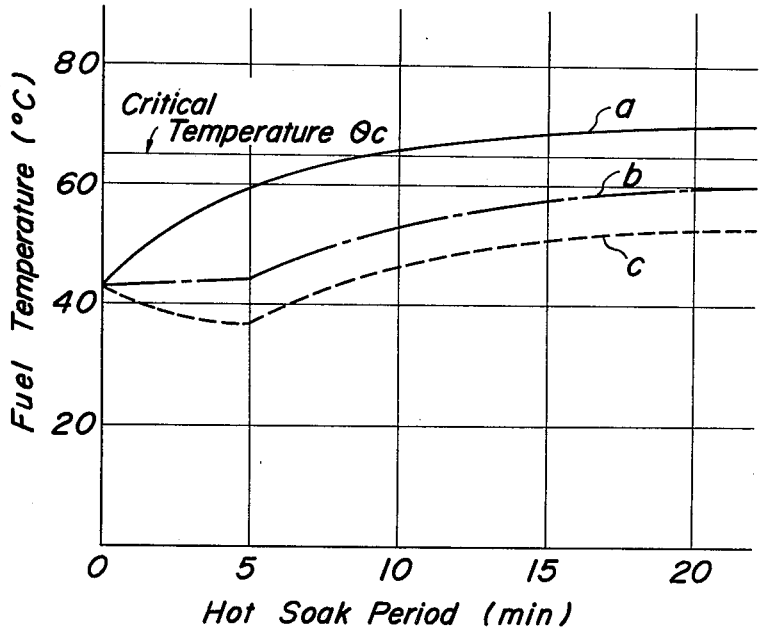
FIG. 5 is a diagram showing the fuel temperature at fuel pump inlet.

The advantage of the present invention is shown in FIG. 5, which shows variations in the fuel temperature at a fuel pump inlet during the hot soak period, or when the engine is stopped after heavy load driving. Curve a shown in FIG. 5 represents temperature change of the fuel in a conventional engine room which utilizes only the natural draught through the louver 6 of the engine hood 7. Fuel temperature exceeds a critical temperaure $\theta c$ which causes vapor lock or percolation after some minutes. According to the embodiment shown in FIG. 2, as shown by curve b, when the fan 5 is driven in the reverse direction for about five minutes after stopping the engine, the fuel temperature does not exceeds the critical temperature $\theta c$. The fan 5 is driven in the reverse direction for about five minutes in the embodiment shown in FIG. 4, which is provided with the air guide plates 8 and 9, so that the temperature of the fuel is kept of relatively low level or even lowered as shown by curve C, and the fuel temperature does not increase evidently even after the fan 5 is subsequently stopped. This shows that, by forming two separate air flow routes in the engine room, i.e. a suction system cooling route passing through the louver, and an exhaust system cooling route, fuel system can be cooled more efficiently.

As is apparent from the foregoing description, the cooling apparatus according to the present invention can be very simply carried into effect, and efficiently cools the engine room and the exhaust system of the engine after the engine is stopped. Since the fuel temperature is kept at low level, vapor lock or percolation of fuel after heavy load driving can be effectively avoided, and restarting and reacceleration performances of the engine are substantially improved. The driving period of the fan is only a few minutes and no manual operation is necessary. The fan is driven automatically when the exhaust manifold is still very hot after stopping the engine.

It will be appreciated that various modifications may be made without departing from the scope of the present invention. For example, the present invention may be applied to an air-cooled engine which is not equipped with a radiator. Further, the fan may be driven under the hot soak condition in the normal direction so as to utilize highly efficient operating range of the fan. In such a case, however, particular attention has to be paid to the fact that, in case of a water-cooled engine, cooling air temperature is slightly increased by passing through the radiator.

What is claimed is:

1. An apparatus for cooling an internal combustion engine contained in a vehicle engine room, comprising:

a motor;

a fan driven by said motor;

first circuit means for energizing said motor to drive said fan in a first direction to introduce fresh air into the engine room to cool the engine in response to a running condition of the engine when the engine room temperature is above a predetermined first temperature;

means for reversing the direction of drive of the fan from said first direction in response to a stopped condition of the engine; and second circuit means connected to said reversing means for energizing said motor in response to a stopped condition of the engine when the engine room temperature is above a predetermined second temperature, whereby the fan is driven in said reverse direction to draw hot air from the engine room until the engine room temperature is lower than said predetermined second temperature.

2. An apparatus as claimed in claim 1, wherein said second circuit means includes a temperature switch means for selectively actuating said motor, said switch means being actuated by detecting the temperature of a portion of the exhaust system of the engine and when the detected temperature is above said predetermined second temperature.

3. An apparatus as claimed in claim 1, further comprising a louver, formed through an engine hood of the engine room, for discharging hot air from the engine room when the fan is driven in said first direction, and for introducing ambient air into the engine room when the fan is driven in said reverse direction.

4. An apparatus as claimed in claim 3, further comprising air guide means defining a first air flow passage extending through the louver and guiding ambient air for cooling the intake system of the engine, and a second air flow passage substantially isolated from the first air flow passage and guiding ambient air for cooling the exhaust system of the engine.

* * * * *